US012144384B2

(12) United States Patent
Murray

(10) Patent No.: US 12,144,384 B2
(45) Date of Patent: Nov. 19, 2024

(54) REMOVABLE CYCLING CHAMOIS

(71) Applicant: David M. Murray, Phoenix, AZ (US)

(72) Inventor: David M. Murray, Phoenix, AZ (US)

( * ) Notice: Subject to any disclaimer, the term of this patent is extended or adjusted under 35 U.S.C. 154(b) by 61 days.

(21) Appl. No.: 18/198,077

(22) Filed: May 16, 2023

(65) Prior Publication Data

US 2023/0363470 A1 Nov. 16, 2023

Related U.S. Application Data

(60) Provisional application No. 63/342,224, filed on May 16, 2022.

(51) Int. Cl.
*A41D 1/084* (2018.01)

(52) U.S. Cl.
CPC ..... *A41D 1/084* (2013.01); *A41D 2600/104* (2013.01)

(58) Field of Classification Search
CPC .... A41D 1/084; A41D 1/08; A41D 2600/104; A41D 13/0537; A41D 13/0568; A41D 13/055; A41D 13/05; A41D 13/0556; A41D 13/0525; A41B 9/004; A41C 1/003; A63B 71/1216; B62J 1/20; A61F 13/64

See application file for complete search history.

(56) References Cited

U.S. PATENT DOCUMENTS

| | | | | |
|---|---|---|---|---|
| 1,828,572 | A * | 10/1931 | Lawrence | A41D 1/06 2/231 |
| 4,229,835 | A * | 10/1980 | Shaw | A41B 9/001 2/221 |
| 7,404,216 | B1 * | 7/2008 | Paramore | A63B 71/1216 602/67 |
| 11,452,319 | B1 * | 9/2022 | Buonincontro | A41D 13/0543 |
| 2017/0258144 | A1 * | 9/2017 | Bardini | A41D 13/0556 |
| 2020/0121001 | A1 * | 4/2020 | Coccia | A41D 13/0556 |
| 2022/0000684 | A1 * | 1/2022 | Gavironda | A61F 13/70 |
| 2022/0388589 | A1 * | 12/2022 | Cheon | B62J 1/28 |

* cited by examiner

*Primary Examiner* — Jillian K Pierorazio
(74) *Attorney, Agent, or Firm* — Accelerate IP LLC

(57) ABSTRACT

A removable chamois comprising a panel with a face, a backside, a frontside, a right side, and a left side, wherein the backside is wider than the frontside. A pad coupled to the face of the panel. A first waist strap and a second waist strap coupled to the backside of the panel, wherein the distal end of the first waist strap is coupled to a first waist buckle and the distal end of the second waist strap is coupled to a second waist buckle, wherein the first waist buckle is configured to detachably couple to the second waist buckle.

12 Claims, 3 Drawing Sheets

REMOVABLE CYCLING CHAMOIS

CROSS REFERENCE TO RELATED APPLICATION

This application claims benefit from currently U.S. Provisional Application No. 63/342,224 titled "Removable Cycling Chamois" and having a filing date of May 16, 2023, all of which is incorporated by reference herein.

TECHNICAL FIELD

The present specification relates to bicycling apparel, more specifically to a chamois that is easily put on and removed over an individuals clothing.

BACKGROUND

Bicycling can be a great way to exercise and provide transportation. It is a low impact exercise which is easier on joints, making it a more desirable exercise option, especially for those with joint issues. In addition to being a great method of exercising, it can also be a great method of transportation which can save money on gas and help protect the environment by producing less pollutants. Bicycling has many accessories that increase the comfort and safety of a rider such as helmets, reflectors, lights, biking shorts, biking shirt, and chamois. The chamois provides cushioning to the perineal area that comes into contact with the saddle to help prevent soreness. The chamois can also help prevent chafing. It is a very important accessory for cyclists. Unfortunately, the typical chamois is integral with biking shorts which makes it necessary for a rider to carry a change of clothing and take the time to change completely.

One conventional chamois is described in U.S. Pat. No. 7,770,765, titled "Chamois For Athletic Shorts Having Relatively Elastic Portion And Relatively Inelastic Portion," issued May 5, 2010, to Africa et al., incorporated herein by reference as if set out in full. The '765 patent provides cycling shorts that has a facing side and body side with material that made out of elastic material to tightly fit around the user. Another common chamois is sewn into shorts so that user doesn't have to wear tight elastic shorts while out riding or going to places in the public. However, both of these chamois require the user to wear separate shorts or pants requiring the user to change their clothes if not bicycling.

Therefore, there is a need for a device that provides comfort and protection to a rider that easily fits over the user's clothing without requiring the rider to change clothing.

SUMMARY

Aspects disclosed herein comprise a removable chamois. The removable chamois can comprise a panel with a face, a backside, a frontside, a right side, and a left side. The backside can be wider than the frontside. A pad can be coupled to the face of the panel. A first waist strap and a second waist strap can be coupled to the backside of the panel. The opposite end of each of the straps can be coupled to a buckle. A first waist buckle and a second waist buckle. The first and second waist buckles can be configured to detachably couple to each other. The removable chamois can comprise a right leg strap and a left leg strap.

The leg straps are coupled to the frontside of the panel. The opposite end of the straps can each be coupled to a buckle, a first right leg buckle and a first left leg buckle respectively. A second right leg buckle can be coupled to the panel right side. A second left leg buckle can be coupled to the panel left side. The first right leg buckle can be configured to detachably couple to the second right leg buckle. The first left leg buckle can be configured to detachably couple to the second left leg buckle. The straps can be adjustable.

The panel can further comprise a right tab on the right side of the panel and/or a left tab on the left side of the panel. The second right leg buckle can be coupled to the right tab, and the second left leg buckle can be coupled to the left tab. The tabs can be integral with the panel, or they can be separate and coupled to the panel. The removable chamois pad can be permanently, or removably attached, and it can be constructed to cushion or comfortably situate male and/or female anatomy.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the. Absent such clear statements of intent to apply a "special" definition, it is the inventor's intent and desire that the simple, plain, and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112 (f). Thus, the use of the words "function," "means" or "step" in the Detailed Description or Description of the Drawings or claims is not intended to somehow indicate a desire to invoke the special provisions of 35 U.S.C. § 112 (f), to define the invention. To the contrary, if the provisions of 35 U.S.C. § 112 (f) are sought to be invoked to define the inventions, the claims will specifically and expressly state the exact phrases "means for" or "step for", and will also recite the word "function" (i.e., will state "means for performing the function of molding a . . . , without also reciting in such phrases any structure, material or act in support of the function. Thus, even when the claims recite a "means for performing the function of molding a . . . , step for performing the function of molding a . . . ," if the claims also recite any structure, material or acts in support of that means or step, or that perform the recited function, then it is the clear intention of the inventors not to invoke the provisions of 35 U.S.C. § 112 (f). Moreover, even if the provisions of 35 U.S.C. § 112 (f) are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

Additional features and advantages of the present specification will become apparent to those skilled in the art upon consideration of the following detailed description of the illustrative embodiment exemplifying the best mode of carrying out the invention as presently perceived.

BRIEF DESCRIPTION OF THE DRAWINGS

These and other features, aspects, and advantages of the present specification will become better understood with regard to the following description, appended claims, and accompanying drawings where:

DETAILED DESCRIPTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the inventions is not limited to the examples that are described below.

Figure 1:
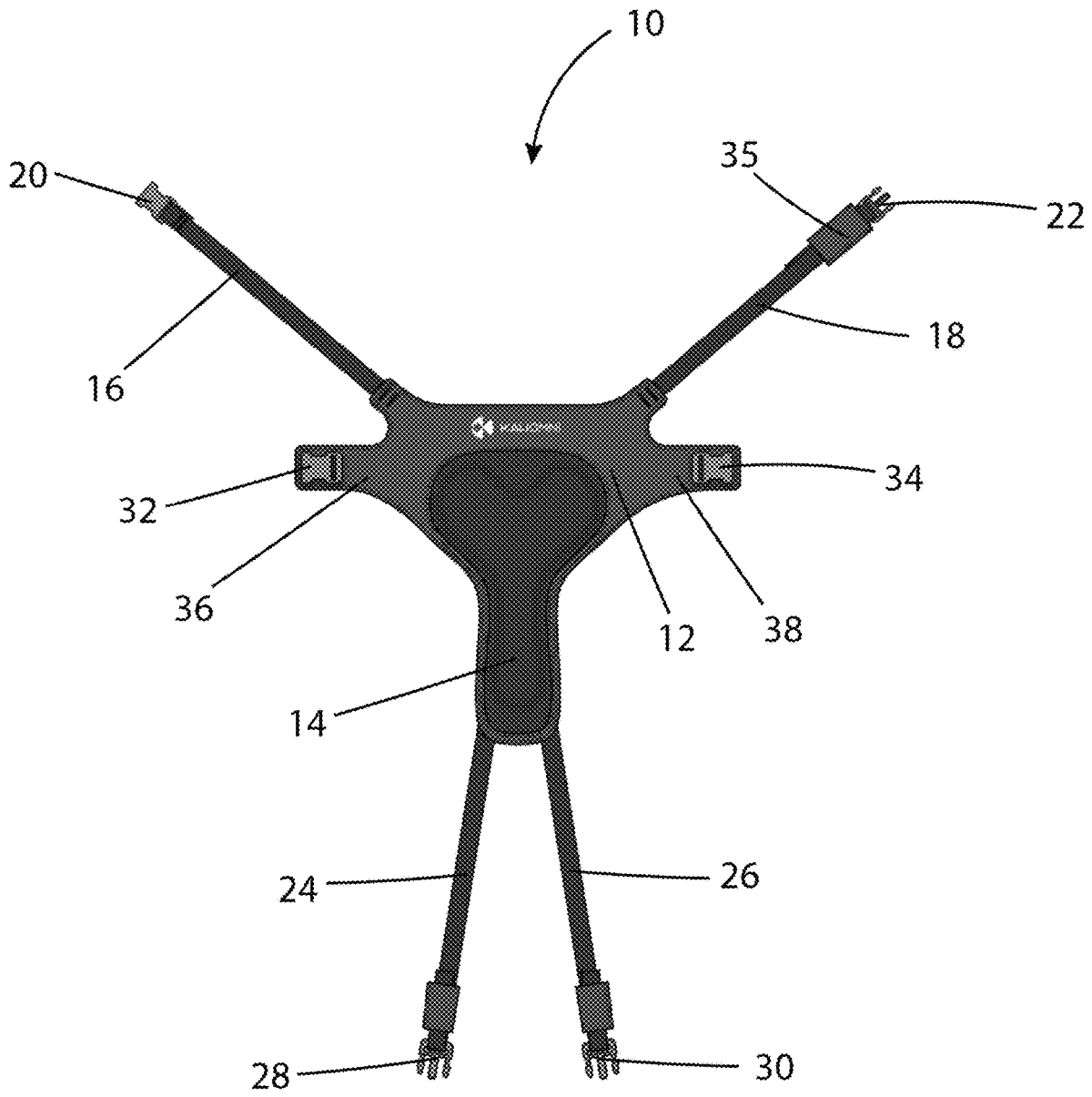
FIG. 1 is a top view of a removable chamois in accordance with one or more embodiments of the invention.

Referring to FIG. 1 a top view of a removable chamois shown generally at 10. The chamois can comprise a panel 12. The panel 12 can have a face, a backside, a frontside, a right side, and a left side, wherein the backside can be wider or in other embodiments thinner than the frontside. The panel 12 can be any material that can conform to a rider, but preferably a fabric, and even more preferably a fabric that can wick moisture and can be anti-microbial such as, for example, polyester, polypropylene, wool, merino wool, cotton, nylon, spandex, lycra, micromodal, neoprene, or the like. The panel 12 can be any shape or size, but the preferred shape is thicker around the buttocks area and narrowing down as it transitions from the buttocks area between the user's legs and crotch area. In certain embodiments, the panel 12 can be custom fitted to the user wherein the panel can fit around the user's buttocks area and then narrow and shape to the user as it moves from the buttocks area to the user's crotch area.

In embodiments, the removable chamois 10 can comprise a pad 14 coupled to the panel 12 wherein the pad 14 can be coupled to either the top face or bottom face of the panel 12 and can be constructed to cushion male anatomy and/or female anatomy. The female anatomy constructed pad 14 can be a bit wider in the sit-bone area, and the male anatomy constructed pad can have an inlet down the middle to provide comfort and space for the male anatomy, or in other embodiments the pad can be universal providing a buttocks support area. The pad 14 can have a thickness that is consistent or caries over the panel, wherein the pad can have an outer shell with an inner material wherein the outer shell can be the same or similar material as the panel 12 and can have a compressible inner material wherein the compressible inner material can be such as, for example, foam, pad, gel, sponge, silicone foam, cotton, leather, or the like. The pad 14 can be one pad or in other embodiments more than one pad spread throughout either the pad area or the panel 12.

In embodiments, the pad 14 can be attached to the panel 12 using any attaching means, such as, stitching, adhesive, snaps, buttons, or the like, or in other embodiments, the pad 14 can be removably attached to the panel using hook and loop, snaps, ties, zippers or the like to allow the user to add or remove different thickness of pads, replace the pad, or clean the pad. In other embodiments, the pad 14 can generally traverse the entire panel 10 or removable chamois and may be thicker in areas that need extra support such as the buttocks area.

In embodiments, the removable chamois 10 can further comprise a first waist strap 16 and a second waist strap 18 which can be coupled to the backside of the panel 12, and in other embodiments it can be couple to the front side of the panel. The distal end of the first waist strap 16 can be coupled to a first waist buckle 20, and the distal end of the second waist strap 18 can be coupled to a second waist buckle 22 wherein the first waist strap and the second waist strap can be couple to the first and second waist buckles by looping the strap through the buckles and sewing or by such as, for example, glue, at least one rivet, pins or the like. The first waist buckle can be configured to be detachably coupled to the second waist buckle 22. In one or more embodiments, when worn by a user, the first waist strap 16 can reach from behind a user's right side across the user's waist, and the second waist strap 18 can reach from behind the user's left side across the user's waist to couple with the first waist strap 16 by way of the first waist buckle and the second waist buckle 22, thus forming a waist band around the user. In certain embodiments, the first waist strap 16 and the second waist strap 18 can have an outer sheath around it wherein the outer sheath can be the similar material as the panel or pad, wherein the outer sheath can add comfort to the user while in use.

In embodiments, the removable chamois 10 can further comprise a right leg strap 24 and a left leg strap 26. The right leg strap 24 and the left leg strap 26 can be coupled to the frontside of the panel 12 by such as, for example, stitching, adhesive, snaps, button, or any combination thereof, or the like. The distal end of the right leg strap 24 can be coupled to a first right leg buckle 28 by such as, for example, loop and hook, stitching, snaps, hooks, or the like. The distal end of the left leg strap 26 can be coupled to a first left leg buckle 30 by such as, for example, loop and hook, stitching, snaps, hooks, or the like. In certain embodiments, the right leg strap 24 and the left leg strap 24 can be removably attached to the right leg buckle 28 and left leg buckle 30.

In embodiments, the removable chamois 10 can comprise a second right leg buckle 32 coupled to the panel 12, and a second left leg buckle 34 coupled to the panel 12 by such as, for example, loop and hook, stitching, snaps, hooks, or the like. The first right leg buckle 28 can be configured to detachably couple to the second right leg buckle 32 by such as, for example, loop and hook, stitching, snaps, hooks, or the like. Similarly, the first left leg buckle 30 can be configured to be detachably couple to the second left leg buckle 34. In one or more embodiments, when worn by the user, the right leg strap 24 can reach from the panel 12 frontside, between the user's legs, across the user's right leg and couple with the backside of the panel through the second right leg buckle 32. Similarly, the left leg strap 26 can reach from the panel 12 frontside, between the user's legs, across the user's left leg and couple with the backside of the panel 12 through the second left leg buckle 34.

In one or more embodiments the panel 12 can comprise a right tab 36 and a left tab 38. The tabs 36 and 38 can extend the panel so that when worn by a user, the tabs 36 and 38 can extend up the side of the user's legs or hips which can add more comfort for the user. In other embodiments, the buckles can have a sleeve that can encompass the buckle allowing for the buckle to be recessed into sleeve and only showing the interior slot of the female buckle or the sleeve can allow for the excess strap to be inserted through it.

The first waist strap 16, second waist strap 18, right leg strap 24, left leg strap 26, right tab, and/or left tab can be adjustable by such as, for example, through the buckles, adjustable straps, webbing slides, cinch strap, or the like. The straps can be comprised of any flexible and strong material, such as webbing, plastic, fabric, leather, metal and/or the like. The first waist strap 16, second waist strap 18, right leg strap 24, and left leg strap 26 can be coupled to the panel through permanent or removable means, such as, for example, stitching, clasps, buckles, swivel connectors, snaps, hook and loops or the like.

The first waist buckle 20, second waist buckle 22, first right leg buckle 28, first left leg buckle 30, second right buckle, and/or second left buckle can be any kind of detachable connection, such as, cam buckles, ratchet buckles, roller buckles, side release buckles, snap buckles, tie buckles, belt buckles, D-ring buckles, double side buckles, box frame buckles, automatic buckles, clip buckles, carabiner, clasp, lock, suspender buckle, dungaree fastener, rectangle buckle sliding bar, or the like.

The removable chamois 10 can comprise a buckle pocket 35. The buckle pocket 35 can be comprised of any flexible material, such as fabric, plastic, silicone, and/or the like. The buckle pocket can surround the sides of the buckle leaving the ends of the buckle open and can allow for the excess strap to be put through it. The buckle pocket 35 can protect the buckle from becoming disconnected unintentionally. Additionally, the buckle pocket 35 can add comfort to the user by providing a softer material between the buckle and the user. The buckle pocket 35 can be around any or all of the buckles and straps and excess strap material. The buckle pocket can be coupled to a strap, or it can be free floating.

Figure 2:
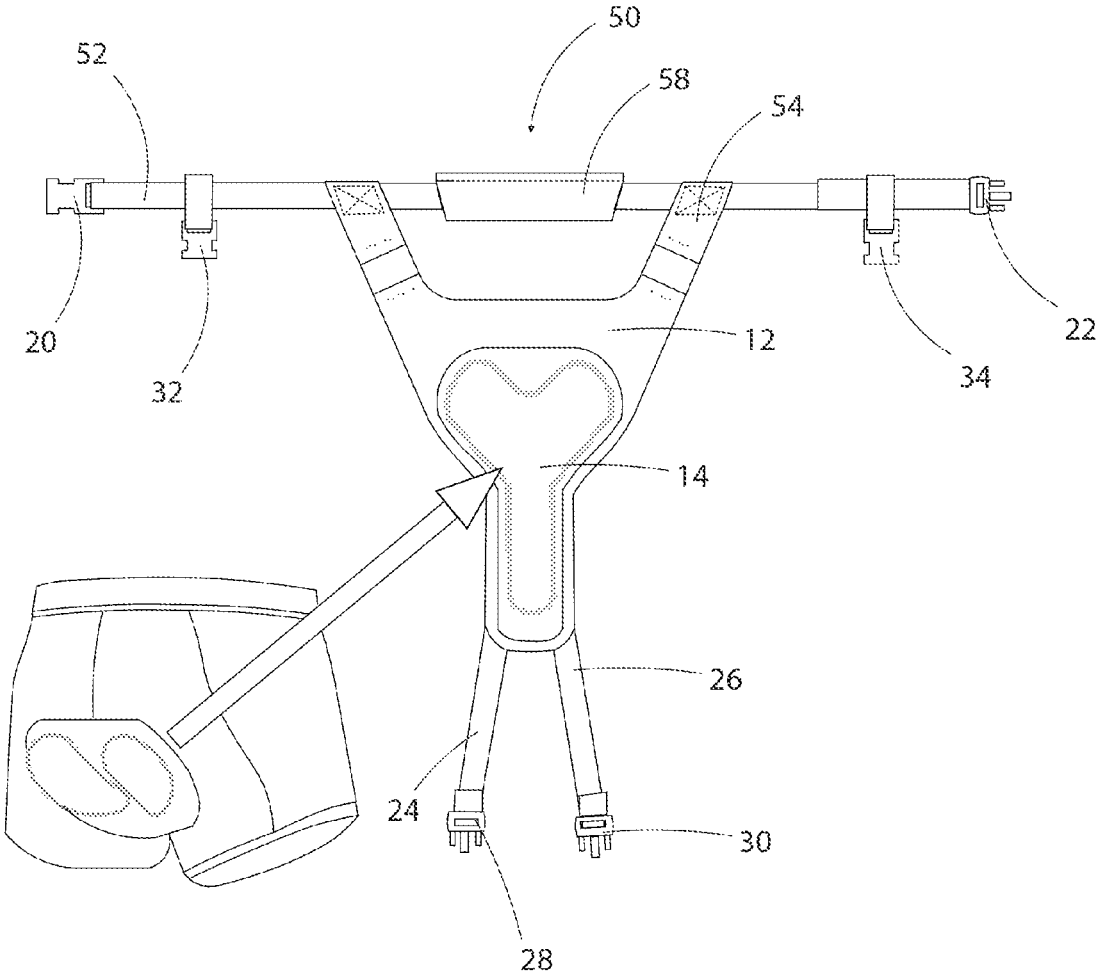
FIG. 2 is a top view of another embodiment a removable chamois in accordance with one or more embodiments of the invention.
Figure 3:
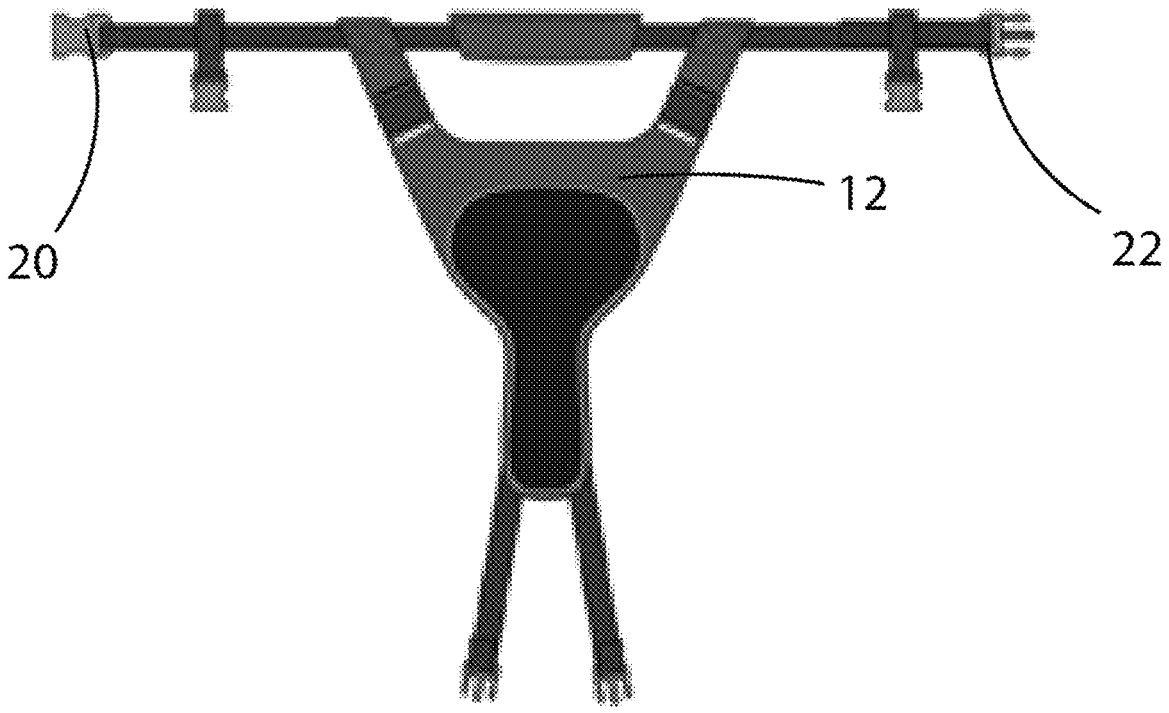
FIG. 3 is a bottom view of another embodiment a removable chamois in accordance with one or more embodiments of the invention.

Referring to FIG. 2 and FIG. 3, another embodiment of a removable chamois is shown generally at 50 and is generally similar to chamois 10 above, and the similarities will not be re-explained herein. The panel 12 can comprise a pad 14 wherein the pad can be any of the foams mentioned above and can be any shape as mentioned above. The panel 12 can transition from the buttocks area to the waste straps 52 wherein the panel can have at least one loop 54 for the waste strap to pass through. The loop 50 can be integrated into the panel or it can be a separate piece that is attached to the panel by such as, for example, sewn, snaps, rivets, buckles, or the like. The waste strap 52 can move freely with in the loops or it can be sewn into each loop keeping the waste strap from moving through the loop. The waste strap 52 can have at least one female buckle 20, but in the preferred embodiment the waste strap can have a first buckle 20 and a second buckle 22 that can be either a female or male buckle, or any type of buckle such as, for example, frame buckle, snap buckle, d-ring, O-ring, plate buckle or the like. The waste strap 52 can be coupled to the first waist buckle 20 and the second waist buckle 22 wherein the waste strap can wrap and be secured around a user's waste. The waste strap 52 can further comprise a sleeve 58 wherein the sleeve can be wrapped around the middle portion of the waste strap to protect the user's waste from the strap from rubbing the user's waste. In other embodiments the sleeve 58 can be omitted.

In embodiments, the waste strap 52 can further comprise a second left leg buckle 34 and second right leg buckle 32 wherein the second leg buckles can be attached to the waste strap by such as for example, a loop that is sewn to the buckle, rivets, snaps, loop and hooks, or the like. The second left leg buckle 34 and the second right leg buckle 32 can be attached to the first left leg buckle 30 and first right leg buckle 28 wherein the first left leg buckle and first right leg buckle can be coupled to the right leg strap 24 and a left leg strap 26. The second left leg buckle 34 and the second right leg buckle 32 can be attached directly to the waste strap 52 or can be attached to the waste strap through webbing that is looped around the waste strap. The second left leg buckle 34 and the second right leg buckle 32, waste strap and right leg strap 24 and a left leg strap 26 can all be adjustable to fit varying size users such as, thickness of legs, and the user's waste.

In closing, it is to be understood that although aspects of the present specification are highlighted by referring to specific embodiments, one skilled in the art will readily appreciate that these disclosed embodiments are only illustrative of the principles of the subject matter disclosed herein. Therefore, it should be understood that the disclosed subject matter is in no way limited to a particular methodology, protocol, and/or reagent, etc., described herein. As such, various modifications or changes to or alternative configurations of the disclosed subject matter can be made in accordance with the teachings herein without departing from the spirit of the present specification. Lastly, the terminology used herein is for the purpose of describing particular embodiments only and is not intended to limit the scope of the present disclosure, which is defined solely by the claims. Accordingly, embodiments of the present disclosure are not limited to those precisely as shown and described.

Certain embodiments are described herein, including the best mode known to the inventors for carrying out the methods and devices described herein. Of course, variations on these described embodiments will become apparent to those of ordinary skill in the art upon reading the foregoing description. Accordingly, this disclosure includes all modifications and equivalents of the subject matter recited in the claims appended hereto as permitted by applicable law. Moreover, any combination of the above-described embodiments in all possible variations thereof is encompassed by the disclosure unless otherwise indicated herein or otherwise clearly contradicted by context.

What is claimed is:

1. A removable chamois comprising:

a panel with a face, a backside, a frontside, a right side, and a left side, wherein the backside is wider than the frontside;

a pad coupled to the face of the panel;

a first waist strap and a second waist strap coupled to the backside of the panel, wherein the distal end of the first waist strap is coupled to a first waist buckle and the distal end of the second waist strap is coupled to a second waist buckle, wherein the first waist buckle is configured to detachably couple to the second waist buckle;

a right leg strap and a left leg strap that are coupled to the panel frontside, wherein the distal end of the right leg strap is coupled to a first right leg buckle and the distal end of the left leg strap is coupled to a first left leg buckle;

a second right leg buckle is coupled to the panel right side, wherein the first right leg buckle is configured to detachably couple to the second right leg buckle;

a second left leg buckle is coupled to the panel left side, wherein the first right leg buckle is configured to detachably couple to the second right leg buckle.

2. The removable chamois of claim 1 wherein the pad is removable.

3. The removable chamois of claim 1 wherein the straps are adjustable.

4. The removable chamois of claim 1 wherein the pad is constructed to cushion at least one of male and female anatomy.

5. The removable chamois of claim 1 further comprising a buckle pocket on at least one of the first waist buckle piece, the second waist buckle piece, the first right leg buckle piece, the second right leg buckle piece, the first left leg buckle piece, and the second left leg buckle piece.

6. The removable chamois of claim 1 further comprising a right tab which is coupled to the panel right side and the second right leg buckle is coupled to the right tab.

7. The removable chamois of claim 6, wherein the right tab is integral with the panel.

8. The removable chamois of claim 1 further comprising a left tab which is coupled to the panel left side and the second left leg buckle is coupled to the left tab.

9. The removable chamois of claim 8, wherein the left tab is integral with the panel.

10. The removable chamois of claim 8, wherein the first waist strap and the second waist strap can have an outer sheath around it that is a covering or a padded covering.

11. The removable chamois of claim 8, wherein the first waist strap and the second waist strap has at least one sleeve that fully or partially enclosure the waste strap.

12. The removable chamois of claim 1, wherein the right leg strap and a left leg strap has at least one sleeve that fully or partially enclosure the right leg strap and a left leg strap.

* * * * *